US008292211B2

(12) United States Patent
Bhunia

(10) Patent No.: US 8,292,211 B2
(45) Date of Patent: Oct. 23, 2012

(54) YARN GRASPING DEVICE FOR AUTOMATIC YARN TRANSFER IN TURRET TYPE WINDERS

(75) Inventor: Pratip Kumar Bhunia, Kanpur (IN)

(73) Assignee: Lohia Starlinger Limited, Kanpur (IN)

( * ) Notice: Subject to any disclaimer, the term of this patent is extended or adjusted under 35 U.S.C. 154(b) by 310 days.

(21) Appl. No.: 12/673,788

(22) PCT Filed: Aug. 14, 2008

(86) PCT No.: PCT/IN2008/000515

§ 371 (c)(1),
(2), (4) Date: Feb. 17, 2010

(87) PCT Pub. No.: WO2009/024999

PCT Pub. Date: Feb. 26, 2009

(65) Prior Publication Data

US 2011/0198432 A1 Aug. 18, 2011

(30) Foreign Application Priority Data

Aug. 17, 2007 (IN) ..... 1751/DEL/2007

(51) Int. Cl.
*B65H 67/048* (2006.01)

(52) U.S. Cl. ..... 242/474.7; 242/476.5; 242/586.2; 242/587.2

(58) Field of Classification Search ..... 242/474.3, 242/474.4, 474.5, 474.6, 474.7, 476.1, 476.2, 242/476.3, 476.4, 476.5, 476.6, 579, 586, 242/586.2, 587, 587.2, 125–125.3
See application file for complete search history.

(56) References Cited

U.S. PATENT DOCUMENTS

| | | | |
|---|---|---|---|
| 4,069,984 | A | 1/1978 | Klink et al. |
| 4,208,016 | A | 6/1980 | Jones et al. |
| 4,856,722 | A | 8/1989 | Horsey et al. |

FOREIGN PATENT DOCUMENTS

| | | | |
|---|---|---|---|
| DE | 19646335 | A1 | 5/1997 |
| EP | 1525 150 | B1 | 4/2005 |

OTHER PUBLICATIONS

European Patent Office, International Search Report and Written Opinion; Jan. 28, 2009.
European Patent Office, International Preliminary Report of Patentability; Nov. 5, 2009.

*Primary Examiner* — William E Dondero
(74) *Attorney, Agent, or Firm* — McDonald Hopkins LLC

(57) ABSTRACT

A yarn grasping device for grasping one or more ends of continuously advancing yarn (5) at the start of the winding operation on an empty bobbin mounted on a spindle (3) of an automatic turret type winder having at least two spindles (3) is disclosed. Said device comprising a support element (10) and a steering element (9), said steering element (9) being provided with at least one slit (11), said device being attached at the free end of each of said spindles (3) such that said steering element (9) and said support element (10) are positioned coaxially with their open faces being offset from each other, and characterized in that at least one grasping element (12) is mounted on said steering element (9) such that said slit (11) is partially covered to form a wedge, and in which wedge said advancing yarn (5) is securely grasped during the automatic changeover of said yarn (5) from the bobbin under winding (3*a*) to an empty bobbin (3*b*).

17 Claims, 4 Drawing Sheets

YARN GRASPING DEVICE FOR AUTOMATIC YARN TRANSFER IN TURRET TYPE WINDERS

FIELD OF INVENTION

Figure 1:
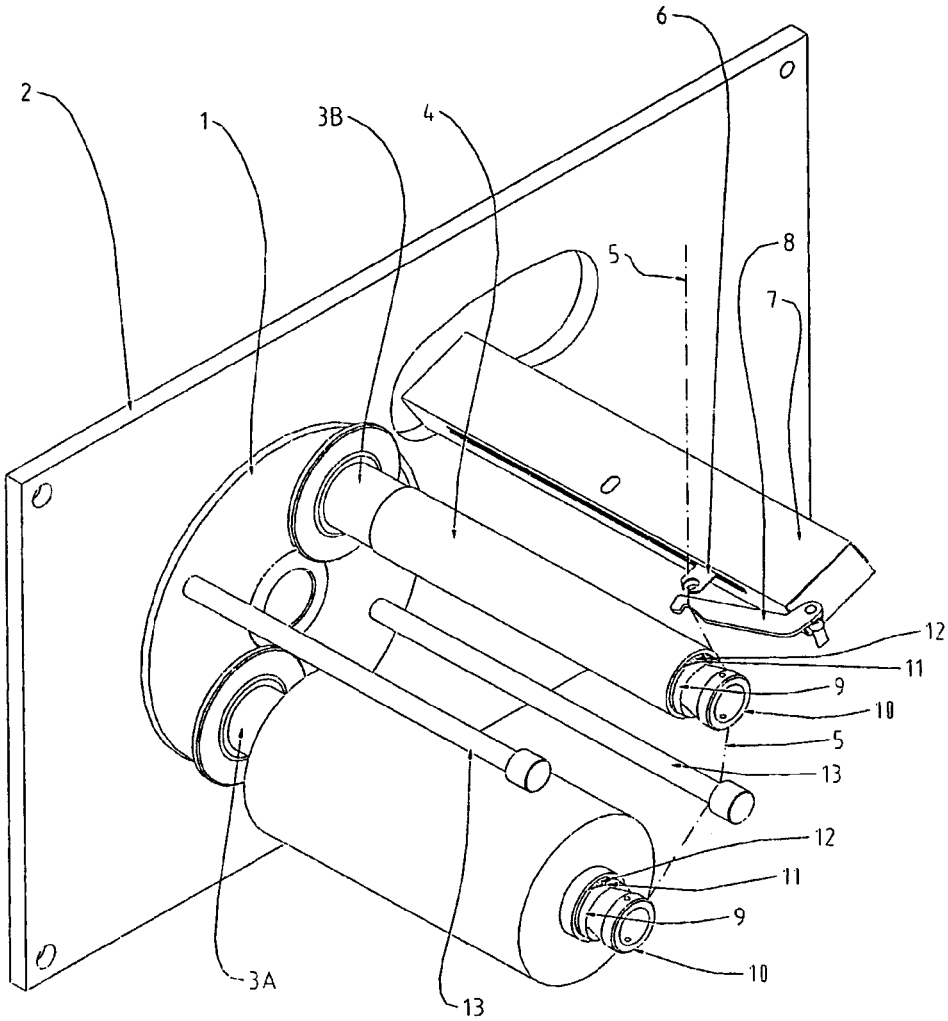

The present invention relates to a yarn grasping device for automatic yarn transfer in turret type winders. In particular the present invention relates to a yarn grasping device that can be used for bobbins of small and large diameters alike.

BACKGROUND OF THE INVENTION

In the following description, the term "yarn" is intended to also include the threads, tapes, profile tapes, fibrillated tapes and slit-film bands of various linear mass density, diameter, width and thickness. The term "bobbin" is intended to include any metallic or non-metallic tubes on which the yarn is wound to form a suitable package. The term 'yarn' is also used to describe yarn with multiple threads or ends that a single winder might receive.

Automatic turret type winders are used in production or take-up process of continuously advancing yarn, for example, in yarn extrusion machines or in rewinding process for making plurality of small size yarn packages from a large yarn package. In general, the turret type automatic winders are positioned side by side in the horizontal direction and stack one above the other in vertical direction. The number of winding positions is exemplary both in horizontal row and vertical row.

In automatic turret type winders, a continuously advancing yarn is generally wound on an initially empty bobbin to form a suitable yarn package. When the pre-determined package size (length/diameter/time) is achieved on a bobbin installed on one of the bobbin holders, generally known as a spindle, the continuously advancing yarn is transferred by an automatic transfer device to an empty bobbin installed on another spindle to make a new yarn package without interrupting the winding operation.

The transferring of yarn from a full bobbin to the empty bobbin will not be successful without a proper yarn grasping device that can ultimately transfer the continuously arriving yarn onto the empty bobbin. Also, if the yarn is not transferred in the first attempt, the continuously advancing yarn gets wasted until it is rethreaded.

Worse still, the continuously advancing yarn, if not controlled properly in case it fails to transfer onto the empty bobbin, may interfere with the other yarn winders on the same machine and cause the entire machinery to stop which results in a huge amount of wastage, machine downtime and economic loss. In the worst situations, some parts of the machinery may get damaged.

Many attempts have been made to provide a winding machine with a yarn grasping device for automatically transferring a continuously advancing yarn to a driven empty bobbin on which the yarn is to be wound subsequently to form a full package.

U.S. Pat. No. 3,921,923 discloses a method of automatically transferring a yarn in an automatic take-up motion of peripheral drive turret type, from a bobbin on which a yarn has been taken-up, to another unwound bobbin on which the yarn is to be wound subsequently. This invention does not describe the yarn grasping device, and furthermore, such type of described winders are normally for filament yarn and used with custom built bobbins made from paper core having limited reusability. One drawback of this invention is that it is complicated and standard bobbins cannot be used in the invention.

U.S. Pat. No. 5,228,630 relates to a turret type yarn winder in which a pair of chucks for holding bobbins are arranged on a turret disc coaxially and symmetrically to each other, and a full bobbin and an empty bobbin held on the respective chucks are alternately exchanged by the rotation of the disc so that the winding operation can be carried out without interruption. The yarn grasping device consists of an annular clamp member, a friction member provided on the base end surface of the spindle and means for engaging and disengaging annular clamp member from friction member at a predetermined phase.

One of the shortcomings of the invention disclosed in the U.S. Pat. No. 5,228,630 is that the use of springs and sliding rings and the fact that the grasp mechanism has multiple hooks, simply makes for a relatively complicated mechanism for grasping the yarn.

The European patent EP 1,525,150 relates to a device for catching a thread at the beginning of a reeling operation using a winder having at least two spindles. The device comprises a catching bushing having a catching slit arranged at the free end of the spindle and a friction pin arranged in the centre of the catching bushing. Additionally, a guiding bushing having a guiding slit is arranged such that the guiding bushing surrounds the catching bushing in radial direction and is positioned with axial distance to the catching bushing. A clamping apparatus for fixing the yarn during an automatic process of change of reels is arranged between the catching bushing and the guiding bushing.

The device and the process described in EP 1,525,150 are generally suitable for use with large diameter bobbins such as those with an inside diameter of 90 mm or so. The device is particularly unsuitable for use with small diameter bobbins. Small bobbins, with diameters of 35 mm or so, are generally used in circular looms which are typically employed for weaving slit-film tapes made from plastic material into woven plastic fabric. The invention described in EP 1,525,150 present an accommodation problem and may cause operational problem during the yarn transfer when used with a bobbin of small size.

Thus, there is need of a simple yarn grasping device capable of working with bobbins of various sizes, particularly, with small inside diameter. Further, the yarn grasping device of turret type winders should also automatically transfer various types of yarn, single and with multiple threads, with high reliability and consistency.

OBJECTS AND ADVANTAGES OF THE INVENTION

One of the objects of the present invention is to provide a simple yarn grasping device suitable for holding yarns of different types and sizes during the automatic bobbin changeover.

Another object of the present invention is to develop the yarn grasping devices of the above described type so as to use, where possible, the existing standard bobbins of various inside diameters, including those with small inside diameter, without modifications in the bobbins available with the user thereof.

It is a further object of this invention to provide a device that can grasp a continuously advancing yarn and therefore, successfully transfer various types of yarn, with consistent higher reliability and less maintenance of the device.

The above objectives of this invention are met by the yarn grasping device according to the claims appended hereto.

SUMMARY OF THE INVENTION

The invention describes a novel yarn grasping device that at start of yarn winding operation facilitates easy and automatic transfer of the continuously advancing yarn from a bobbin under winding to an empty bobbin in a turret type yarn winding machine. The yarn grasping device of the invention comprises a steering element and a support element, wherein the steering element is provided with a novel arrangement of slits and yarn grasping elements. The yarn grasping device is fitted on standard spindles used in yarn winders such that, with the help of a standard yarn laying mechanism, the continuously advancing yarn in a turret type yarn winding machine is transferred from a full bobbin onto an empty bobbin successfully.

LIST OF PARTS

| | |
|---|---|
| 1. | Turret |
| 2. | Base plate |
| 3. | Spindle (3A, and 3B - spindles with full and empty bobbins respectively) |
| 4. | Empty Bobbin. |
| 5. | Continuously advancing yarn |
| 6. | Traverse guide |
| 7. | Traverse unit |
| 8. | Transfer pin |
| 9. | Steering element |
| 10. | Supporting element |
| 11. | Slit of steering element |
| 11a. | Entrance of the wedge/slit |
| 11b. | Angle of the slit |
| 12. | Grasping element |
| 12a. | Recess for the grasping element |
| 13. | Extended bar |
| 14. | Threaded screw |
| 15. | Wedge |

BRIEF DESCRIPTION OF THE ACCOMPANYING DRAWINGS

FIG. 1: Isometric view of automatic turret type winder fitted with the device of the present invention FIG. 2: Assembled view of the device of the present invention FIG. 3: Exploded view of the device of the present invention FIG. 4: Zoomed in view of the device of the present invention.

DETAILED DESCRIPTION OF THE INVENTION

FIG. 1 shows a typical turret type automatic yarn winder in which the device of the present invention is used. A typical turret type automatic yarn winder comprises a mechanism to accommodate bobbins and a mechanism to transfer the advancing yarn from the bobbin that is being wound on to the empty bobbin. On the rotating turret (1) mounted on the base plate (2), there are at least two spindles (3A & 3B) arranged preferably symmetrically to each other and perpendicular to the turret base. Further preferably, these are positioned equidistant from turret central axis and also equidistant in angular direction A bobbin (4) is mounted on each of the spindles which are individually driven and controlled. As shown in FIG. 1, the full package formation of the yarn is represented by the bobbin mounted on spindle (3A) and the empty bobbin on which the yarn winding is to commence after the yarn transfer is shown as spindle (3B).

In automatic yarn winding machines, the continuously advancing yarn (5) is transferred from the bobbin being wound to the empty bobbin (3*b*). At the beginning of the yarn transfer process, the transfer pin (8) shifts the advancing yarn (5) from the traverse guide (6) and novel yarn grasping device of the present invention transfers it to the empty bobbin. At this stage, the yarn's end attached to the full bobbin is severed off, completing the yarn transfer. One of the key parameters upon which the successful yarn transfer depends is the maintenance of the winding tension in the yarn. The winding tension is the result of the slightly higher linear speed of the bobbin, or the surface, on which the yarn is being wound at any point in time and the linear speed of the advancing yarn. The linear speed of the bobbin at a given point in time is the rotational speed of the bobbin multiplied by the diameter of the bobbin.

Figure 2:
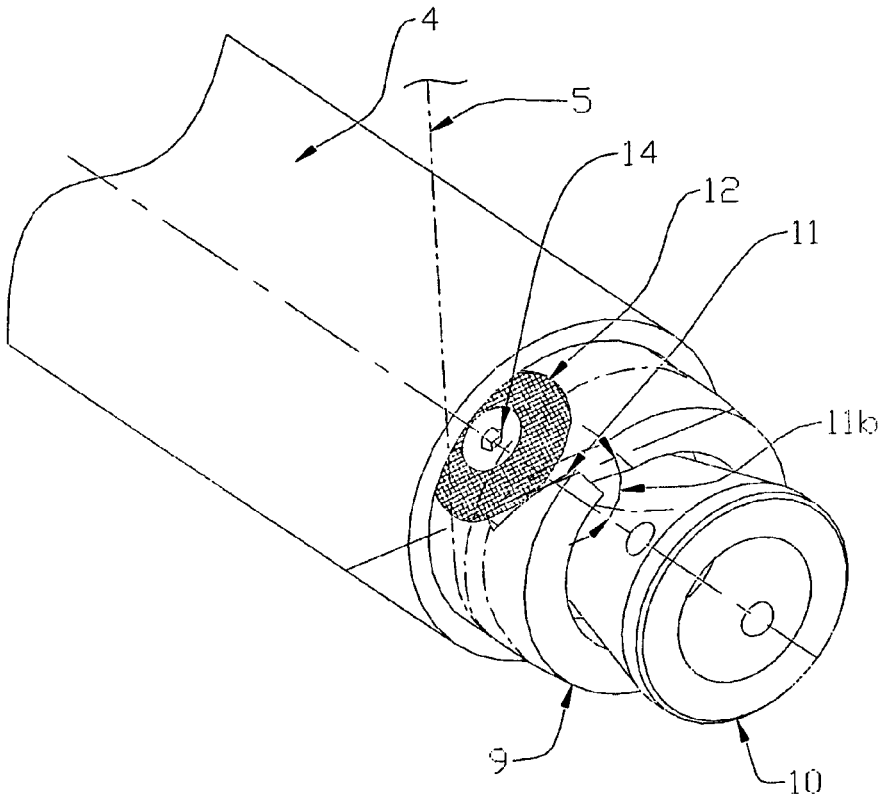

As shown in FIG. 2, the novel yarn grasping device of the present invention comprises a supporting element (10) that is located at the free end of the spindle and which is concentrically located inside a steering element (9). The open faces of the supporting element (10) and the steering element (9) are offset from each other axially by a suitable distance for guiding the yarn to one of the slits (11) of the steering element (9). The outer diameter of the supporting element (10) is somewhat smaller than the inside diameter of the steering element (9), and the outside diameter of the steering element (9) is preferably somewhat smaller than the inside diameter of the bobbin that is mounted on the spindle (3). However, depending on the spindle or bobbin holder design, the outside diameter of the steering element (9) can be the same as or slightly bigger than the outer diameter of the bobbin.

The supporting element (10) is made of any metallic materials such as iron, copper, brass, alloys, preferably steel, or non-metallic materials such as wood, rubber, or plastics, or any combination of such materials. It is made in any cross-sectional shape, preferably a symmetrical polygon, more preferably a circular shape. The supporting element (10) preferably has a shape selected from a group comprising cylindrical, pyramidal, preferably that of a circular cone, the base of the cone being positioned at the free end of the spindle (3).

The steering element (9) can be made from metallic or non-metallic materials, preferably light weight materials like plastic or aluminum, so that there is less weight-imbalance in spindle for the same manufacturing accuracy, while still achieving even higher-than-normal rotating speeds of the spindle (3). The steering element (9) is fitted to the spindle by a screw-on arrangement or by using a snap-fit or clamp-on method or any other method such as fastening, gluing, welding, embedding, or any combination thereof.

The steering element (9) has at least one slit (11), the slit (11) being positioned at an angle (11*b*) measured with respect to the spindle longitudinal axis, so that the yarn can enter it with ease during the changeover of the bobbins. The angle (11*b*) is in the range between 1° to 89°, preferably in the range between 40° to 80°, even more preferably 50° to 65°. The slit (11) in the steering element (9) helps to precisely lead the yarn toward the grasping element (12) and further helps in grasping the yarn. The difference between the outer diameter of the supporting element (10) and inside diameter of the steering element (9) is kept as small as possible thereby enabling use of small size bobbins for yarn winding. This is one of the key advantages of the present invention.

Figure 3:
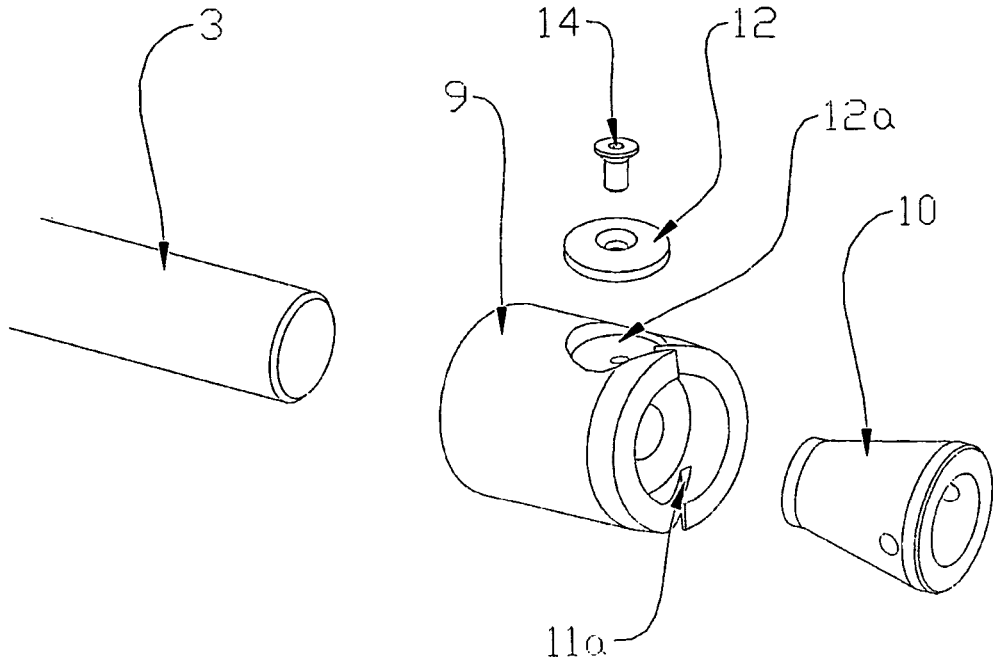
Figure 4:
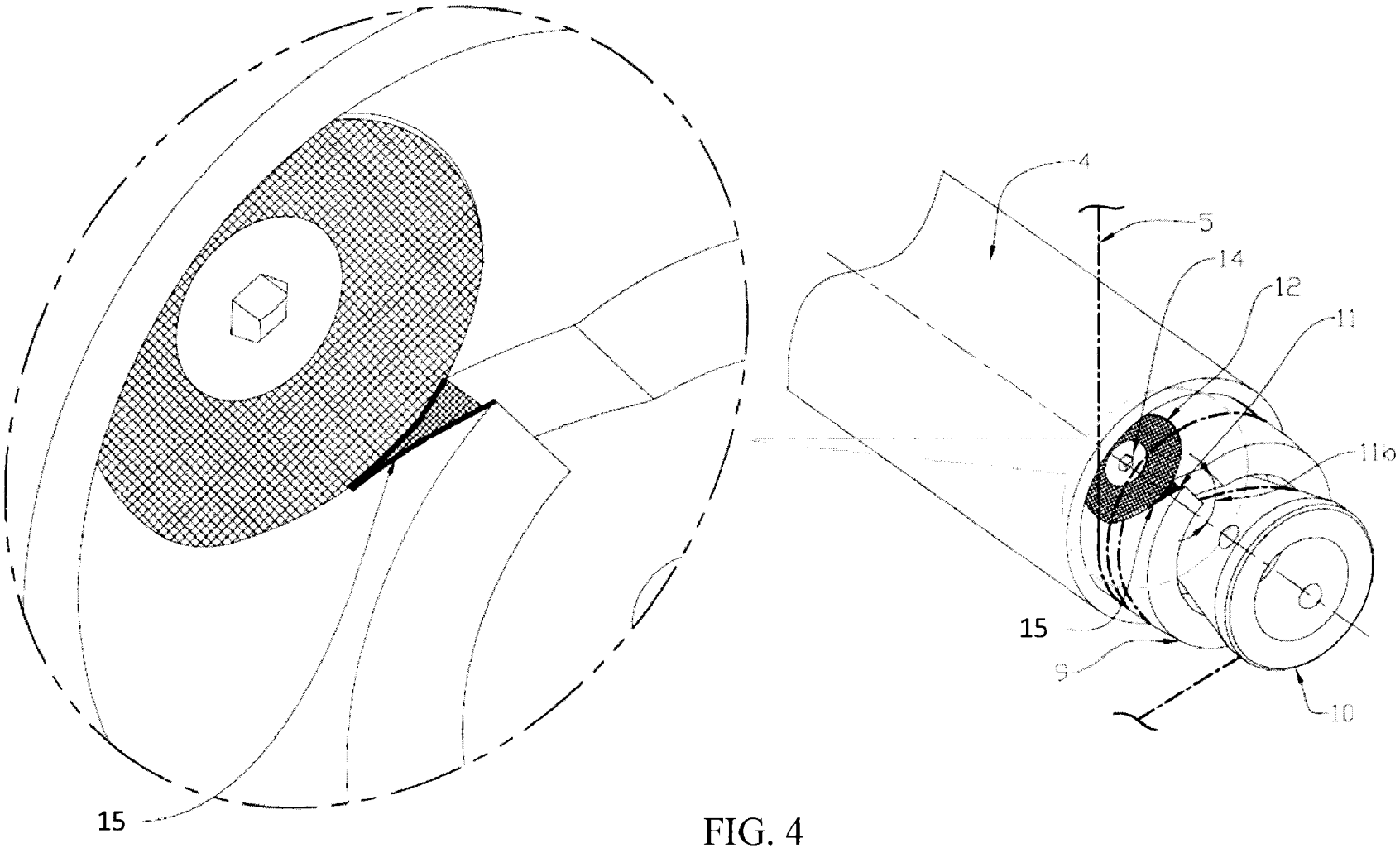

As shown in FIG. 3, the slit (11) leads to a recess (12*a*) provided on the outer surface of the steering element (9) in which a grasping element (12) is mounted for the purpose of securely fixing the yarn onto the steering element (9) and ultimately onto the empty bobbin. The slit (11) is made into the steering element (9) and thus forming an inner edge and an outer edge, and also an inner surface and an outer surface. The slit (11) is made such that its edges and surfaces are blunt and in any smooth profile that leads up to the grasping element (12). The grasping element (12) is designed such that once placed in the recess (12*a*), it suitably covers the inner edge of the slit (11) such that a wedge shape (15) is formed. During the yarn transfer process, the continuously advancing yarn (5) is first grasped at the end of the wedge (15) and then transferred onto the revolving empty bobbin (3*b*) with the movement of a suitable device, for example a transfer pin (8). The simplicity of the present invention is such that during the bobbin transfer/changeover, the continuously advancing yarn (5) is grasped with great reliability before commencing of the winding of the yarn on the empty bobbin.

The entrance (11*a*) of the wedge is made wide enough to easily lead a range of available yarn widths and thicknesses. The device of the present invention thus caters to a variety of yarn types, without requiring change in the grasping device and any major settings. The device also allows grasping of yarn that has two or more threads. All edges of the slit (11) and the grasping element (12) are made blunt enough to avoid the yarn being cut before it is grasped by the grasping device; untimely and accidental cutting of the yarn can cause failure of the yarn transfer process during bobbin changeover.

According to a preferred embodiment, the steering element (9) has a plurality of slits (11), preferably two circumferential slits (11) set at an inclined angle to the spindle longitudinal axis and angle being oriented in the same direction.

In the embodiment of the present invention that comprises two slits (11), the slits (11) are positioned preferably diametrically opposite to each other, thereby balancing the steering element (9) and for narrowing down the yarn grasping time deviation resulting in consistent repeatability of yarn grasping function.

The profile of edges of the slit (11) may be any curvilinear profile that allows yarn movement within the slit (11) without the risk of cutting the yarn. A part of the grasping element (12) may optionally cover the faces of the slit (11) as appropriate.

In another embodiment of the present invention, the recess (12*a*) is in the form of a peripheral ring cut into the steering element (9). In a still further embodiment of the present invention the recess (12*a*) may be of any profile such that it can accommodate a compatible grasping element which will form a suitable wedge with the slit (11).

The grasping element (12) is preferably in the form of a disk or a ring. It can also be in the form of a flexible sheet material which can be glued on directly on the surface of the steering element (9) without the provision of a recess (12*a*). In the case where a flexible sheet type material is used, the slit (11) is cut in the shape of a wedge, preferably a pointed wedge, wherein the inner and outer edges meet in a point. The flexible sheet material is then provided such that the inner surface of the slit (11) is also covered by it.

The grasping element (12) is made from any material having cushioning effect, preferably from natural or synthetic elastomeric material, most preferably, special rubber having good abrasion resistance, whereby the grasping element (12) is capable of handling various types of yarns. Alternatively, the grasping device is made in the form of a spring loaded disc.

Another important advantageous feature of this invention is that the grasping element (12) can have any geometrical shape and size, preferably a circular shape. This shape enables the grasping element (12) to serve for a long time. As and when a specific portion of grasping element (12) receiving the yarn gets worn out, it can simply be turned a bit and continue to serve, thereby increasing the lifespan of the grasping element (12), ultimately leading to saving in the maintenance time and cost effectiveness.

Operation of the Invention

When a first bobbin receives a signal to doff either by reaching pre-determined size or intentional activation by an operator, the process of transferring the yarn onto an empty bobbin is initiated. At the beginning of yarn winding operation and in the yarn transfer process, the transfer pin (8) shifts advancing yarn (5) from the traverse guide (6) and places it around the support element of the grasping device provided on the spindle carrying an empty second bobbin such that the advancing yarn (5) stays near the cross-sectional face of the steering element (9). The transfer pin (8) guides the yarn into the slit (11) in steering element (9) subsequently leading it to the end of the wedge formed by the slit (11) and the grasping element (12). The tension in the yarn (5) along with the rotational motion of the support element (10), secures the yarn (5) into the wedge. The continued rotational motion of the bobbin allows the transfer guide to transfer the yarn (5) onto the bobbin. The end of the yarn leading to the full bobbin is severed due to the continued tension in the yarn.

In a typical yarn winding operation, the continuously arriving yarn (5) is laid across the bobbin with the help of the to-and-fro motion (traversing motion) of a suitable device such as a traverse guide (6), which in turn is driven by another suitable device, for example a traversing unit or a cam-box (7). As and when the pre-determined full package formation is achieved or intentional doffing signal activated, the spindle carrying an empty bobbin (3B) starts rotating. The traversing unit or the cam-box (7) swivels towards the extreme position away from the spindle and the turret (1) rotates in the same direction as spindle, such that the empty bobbin is situated in a position to receive the yarn (5) (see FIG. 1). In case of the preferred embodiment where two spindles are placed symmetrically about the central axis of the turret, the angle of rotation is 180°.

As the turret (1) completes the rotation, the cam-box swivels towards the spindle (3B) and subsequently the traverse guide (6) stops at pre-determine position, preferably at the extreme position of traversing box (7) towards the free end of spindle (3), and is sensed by a suitable sensing mechanism such as a proximity sensor. The continuously arriving yarn (5) is shifted out of the plane of winding on to the support element by a suitable transfer device such as the transfer pin (8) or by axial movement of traverse unit (7)/cam-box (7). The transfer pin (8) moves the yarn away from the winding area and ahead of the outer edge of steering element (9). The continuously advancing yarn (5) is supported by the supporting element (10) in a manner that the yarn stays in front face of the steering element (9) towards the traverse unit (7). Guided by the transfer pin (8), the yarn (5) placed at the front face of the steering element (9) rapidly enters the entrance (11*a*) of the earliest arriving wedge. The yarn (5) now entered the slit (11) is precisely led to the wedge formed by the grasping element (12) and the slit (11), where it is firmly grasped. Under the continued rotational motion of the spindle (3B), the continuously arriving yarn (5) gets wrapped tightly around the steering element (9) which is rotating in the same direction as the other spindle (3A); the other end of the yarn is on the bobbin that is placed on the spindle (3A). This action creates a tensional/pulling force in the yarn (5) which is also supported and additionally tensioned by a suitable element such as an extended bar (13) located between the pair of spindles (3A and 3B). The continued tension in the yarn results in its rupture, thereby physically completely disconnecting the two spindles (3A and 3B) from each other. The full bobbin can be doffed manually or by suitable automatic device. The arriving yarn (5) continues to wind on the bobbin mounted on spindle (3B) without any interruption following the successful yarn transfer with the help of invented yarn grasping device.

In order to understand one of the key advantages of the present invention, that is to facilitate the use of small diameter bobbins for making yarn packages, it will be useful to revisit the invention disclosed by EP 1,525,150. The patent document EP 1,525,150 discloses a device for catching a thread at the beginning of a reeling operation wherein the catching bushing diameter is smaller than the guiding bushing, which in turn has an outside diameter smaller than the outer diameter of the spindles. At the start of the yarn transfer process, the yarn is clamped between the catching bushing and the guiding bushing and then wrapped on the catching bushing, before shifting it onto the empty bobbin.

Table 1 shows typical dimensions of the bobbins that are prevalent in the industry. Consider, for example, a bobbin with an outside diameter (OD) of 96 mm and the inside diameter (ID) of 90 mm, which is an industry standard. A person skilled in the art would know that in this instance, the outside diameter of the guiding bushing will be about 88 mm to 90 mm. As shown in Table 1, depending on the inner wall thickness (Thk) of the guiding bushing and clamping element thickness, the catching bushing will have an outside diameter about 76 mm to 78 mm. Thus the outside diameter of the catching bushing would be approximately 20% to 25% smaller than the outside diameter of the bobbin. It is a known practice for a person skilled in the art to step up the rotational speed of the spindle during threading operation, so that its equivalent linear speed (known as the surface winding speed) is, for example, about 5 to 10% more than the yarn production speed. This would result in surface winding speed of yarn grasping device element, such as the catching bushing, to be about 18 to 20% less than the line/production speed. The speed differential between the surface winding speed and the linear speed of the arriving yarn has to be compensated to an acceptable extent in order for an uninterrupted continuous yarn winding process to take place. In case of large diameter bobbins, where the speed differential is in the 18-20% range, it can be possibly compensated by suitable device like tension compensator (dancer arm), resulting in uninterrupted continuous yarn winding process.

For small diameter bobbins, it is difficult if not impossible to compensate for the speed differential using the invention of EP 1525150. In case of a small diameter bobbin, say, with outside diameter of 40 mm and inside diameter of 35 mm, outside diameter of the guiding bushing would be about 33 mm. As shown in Table 1, and as a person skilled in the art is aware, depending on the wall thickness of the guiding bushing and the clamping element thickness, the catching bushing will have an outside diameter about 26 mm to 21 mm. Therefore, the outside diameter of the catching bushing will be approximately 40 to 45%—smaller than the outside diameter of the bobbin. This would result in surface winding speed of yarn grasping device element such as the catching bushing being about 38 to 50% less than the linear speed of the arriving yarn. The speed differential of this magnitude is practically impossible to compensate by any available devices such as the tension compensator (dancer arm) or any other means known to a person skilled in the art. This would result in slack or loose yarn which would not be wound on bobbin, thereby piling up in a heap and cause interruption in the continuous yarn winding process.

In the yarn grasping device of the present invention during the yarn transfer, the yarn is grasped by the grasping element (12) and suitably wrapped on the steering element (9) which has outside diameter equal or smaller than outer diameter of spindles. Thus, for example, in particular, if relatively small inside diameter bobbin of 35 mm is considered then the steering element (9) can have outside diameter of 34 mm or 32 mm. Hence, surface winding speed of yarn grasping device element like steering element (9) would be approximately 8 to 10% less than the line speed which can be easily compensated by a suitable device such as a tension compensator or load-cell tension speed controller. As a key advantage of the device of the present invention, this would result in smooth yarn transfer and continued uninterrupted winding process.

The yarn grasping device according to the invention can be used in the automatic turret type winder, for example in yarn extrusion machines or in rewinding process for making plurality of small size packages from large package.

As has been evident from the ongoing discussion, a key advantage of the present invention is that it is capable of working with bobbins of various sizes, particularly, with relatively small inside diameter.

Another advantage of the present invention is that it not only minimizes the wastage of the continuously advancing yarn (5) at the time of doffing but also minimizes manpower involvement. A further advantage of the present invention is that it works with high reliability so that there is no loose yarn which may interfere with the other spindles on the same winder, or indeed operation of other winders in the overall winding machinery. The present invention minimizes

TABLE 1

Typical dimensions of yarn grasping elements in mm

| | Yarn grasping device | Spindle | Bobbin | | Guiding bushing | | | Catching element | Catching bushing |
|---|---|---|---|---|---|---|---|---|---|
| Sr. No. | Type | OD | OD | ID | OD | Thk | ID | Thk | OD |
| 1 | EP 1 525 150 | 90 | 96 | 90 | 88 | 2 | 84 | 3 | 78 |
| 2 | EP 1 525 150 | 90 | 96 | 90 | 88 | 2 | 84 | 4 | 76 |
| 3 | EP 1 525 150 | 35 | 40 | 35 | 33 | 2 | 29 | 3 | 26 |
| 4 | EP 1 525 150 | 35 | 40 | 35 | 33 | 2 | 29 | 4 | 21 |
| | | | | | Steering element | | | | |
| 5 | Present Invention | 35 | 40 | 35 | 33 | | | Not applicable | |

chances of disturbing or even stopping the automatic working of the winder and requiring supplementary manpower to put everything in order.

From the foregoing discussion it would be clear that the present invention preferably comprises the following A yarn grasping device for grasping one or more ends of continuously advancing yarn (5) at the start of the winding operation on an empty bobbin mounted on a spindle (3) of an automatic turret type winder having at least two spindles (3), said device comprising a support element (10) and a steering element (9), said steering element (9) being provided with at least one slit (11), said device being attached at the free end of each of said spindles (3) such that said steering element (9) and said support element (10) are positioned coaxially with their open faces being offset from each other, and characterized in that at least one grasping element (12) is mounted on said steering element (9) such that said slit (11) is partially covered to form a wedge, and in which wedge said advancing yarn (5) is securely grasped during the automatic changeover of said yarn (5) from the bobbin under winding (3*a*) to an empty bobbin (3*b*).

Preferably, the steering element (9) has a plurality of slits (11), preferably two circumferential slits (11) being positioned at an inclined angle (11*b*) measured with respect to the spindle (3) longitudinal axis, in which the yarn (5) can enter it with ease during the changeover of the bobbins and in that the said angle (11*b*) is in the range between 1° to 89°, preferably in the range between 40° to 80°, even more preferably 50° to 65°.

Preferably, at least one of the said grasping element (12) is in the form of element with substantial thickness or a ring or flexible sheet or spring loaded disc preferably grasping element (12) have a disk shape.

Preferably, the steering element (9) preferably has a recess (12*a*), the recess being either in the form of a continuous peripheral ring or as discrete entities which accommodate a compatible grasping element (12).

Preferably, the grasping element (12) is made from any material having cushioning effect preferably from natural or synthetic elastomeric material, most preferably special rubber having good abrasion resistance.

Preferably, the edges of the slit (11) are designed to be blunt.

Preferably, said supporting element (10) has any cross-sectional shape, preferably a symmetrical polygon, more preferably a circular shape, and preferably has an overall shape selected from a group comprising cylindrical, pyramidal, preferably that of a circular cone, the base of the cone being positioned at the free end of the spindle (3).

Preferably, the difference between the outer diameter of the supporting element (10) and inside diameter of the steering element (9) is kept as small as possible and in that the outside diameter of the steering element (9) is preferably smaller than the inside diameter of the bobbin.

While the above description contains many specificities, these should not be construed as limitation in the scope of the invention, but rather as an exemplification of the preferred embodiments thereof. Many other variations are possible. Accordingly, the scope of the invention should be determined not by the embodiments illustrated, but by the appended claims and their legal equivalents.

I claim:

1. A yarn grasping device for grasping one or more ends of continuously advancing yarn at the start of the winding operation on an empty bobbin mounted on a spindle of an automatic turret winder having at least two spindles, said device comprising a support element and a steering element, said steering element being provided with at least one slit, said device being attached at the free end of each of said spindles such that said steering element and said support element are positioned coaxially and each having open faces being offset from each other, wherein at least one grasping element is mounted on said steering element such that said slit is partially covered to form a wedge, and in which wedge said advancing yarn is securely grasped during the automatic changeover of said yarn from the bobbin under winding to an empty bobbin.

2. A device as claimed in claim 1, wherein the steering element has a plurality of slits positioned at an inclined angle measured with respect to the spindle longitudinal axis, in which the yarn can enter the slit during the changeover of the bobbins and in that the said angle is in the range between 1° to 89°.

3. A device as claimed in claim 2, wherein said angle is in the range between 50° to 80°.

4. A device as claimed in claim 2, wherein said angle is in the range between 55° to 65°.

5. A device according to claim 1, wherein at least one of the said grasping element is in the form of element with substantial thickness or a ring or flexible sheet or spring loaded disc.

6. A device as claimed in claim 5, wherein said grasping element has a disc shape.

7. A device according to claim 1, wherein the steering element has a recess, the recess being either in the form of a continuous peripheral ring or as discrete entities which accommodate a compatible grasping element.

8. A device according to claim 1, wherein the grasping element is made from any material having cushioning effect.

9. A device as claimed in claim 8, wherein said grasping element is made from a natural or synthetic elastomeric material.

10. A device as claimed in claim 8, wherein said grasping element is made from a rubber having good abrasion resistance.

11. A device according to claim 1, wherein the edges of the slit are designed to be blunt.

12. A device according to claim 1, wherein said supporting element has any cross-sectional shape.

13. A device as claimed in claim 12, wherein said cross-sectional shape is a symmetrical polygon shape.

14. A device as claimed in claim 12, wherein said cross-sectional shape is a circular shape.

15. A device as claimed in claim 12, wherein said supporting element has an overall shape selected from a group comprising cylindrical, pyramidal, and a circular cone, the base of the cone being positioned at the free end of the spindle.

16. A device according to claim 1, wherein the difference between the outer diameter of the supporting element and inside diameter of the steering element is kept as small as possible.

17. A device as claimed in claim 16, wherein said outside diameter of the steering element is smaller than the inside diameter of the bobbin.

* * * * *